US008622177B2

(12) United States Patent
Acquaviva

(10) Patent No.: US 8,622,177 B2
(45) Date of Patent: Jan. 7, 2014

(54) CONTROL SYSTEM AND ENERGY STORAGE FOR AN ELEVATOR APPARATUS

(75) Inventor: Sebastiano Acquaviva, Pino Torinese (IT)

(73) Assignee: Brea Impianti S.U.R.L., Martina Franca (Taranto) (IT)

( * ) Notice: Subject to any disclaimer, the term of this patent is extended or adjusted under 35 U.S.C. 154(b) by 271 days.

(21) Appl. No.: 13/001,386

(22) PCT Filed: Jun. 24, 2009

(86) PCT No.: PCT/IB2009/052703

§ 371 (c)(1),
(2), (4) Date: Dec. 23, 2010

(87) PCT Pub. No.: WO2009/156953

PCT Pub. Date: Dec. 30, 2009

(65) Prior Publication Data

US 2011/0100760 A1 May 5, 2011

(30) Foreign Application Priority Data

Jun. 24, 2008 (IT) ..... TO2008A0494

(51) Int. Cl.
*B66B 1/06* (2006.01)

(52) U.S. Cl.
USPC ..... 187/290; 187/393; 187/285

(58) Field of Classification Search
CPC ..... B66B 1/34
USPC ..... 187/247, 289, 290, 296, 297, 391–393, 187/285; 318/375, 376, 798–815, 161
See application file for complete search history.

(56) References Cited

U.S. PATENT DOCUMENTS

| | | | | |
|---|---|---|---|---|
| 5,712,456 | A * | 1/1998 | McCarthy et al. | 187/290 |
| 5,896,948 | A * | 4/1999 | Suur-Askola et al. | 187/290 |
| 5,909,017 | A * | 6/1999 | Born et al. | 187/297 |
| 5,936,375 | A * | 8/1999 | Enoki | 318/727 |
| 6,431,323 | B2 * | 8/2002 | Tajima et al. | 187/290 |
| 6,742,630 | B2 * | 6/2004 | Eilinger | 187/290 |
| 7,165,654 | B2 | 1/2007 | Takehara et al. | |
| 7,228,942 | B2 * | 6/2007 | Takehara et al. | 187/290 |
| 7,246,686 | B2 * | 7/2007 | Smith et al. | 187/290 |

(Continued)

FOREIGN PATENT DOCUMENTS

| | | |
|---|---|---|
| JP | 11-299275 A | 10/1999 |
| JP | 2003-246586 A | 9/2003 |

OTHER PUBLICATIONS

International Search Report for International Application No. PCT/IB2009/052703 dated Dec. 2, 2009.

*Primary Examiner* — Anthony Salata
(74) *Attorney, Agent, or Firm* — Sughrue Mion, PLLC

(57) ABSTRACT

A control system is provided and includes energy accumulators (20; 120) coupled to a first inverter (10) and controlled through a second inverter (12). These accumulators (20; 120) are adapted to store the energy generated by an electrical machine (3) associated with the elevator apparatus (1), and the energy coming by a source and optionally not used by the machine (3), as well as to deliver the stored energy towards the machine (3) when this requires energy with a power higher than a threshold. The system is arranged to automatically cause the lifting of the car (2) up to the highest floor when preset conditions occur in a time interval of inactivity of the elevator apparatus (1).

11 Claims, 3 Drawing Sheets

(56) References Cited

U.S. PATENT DOCUMENTS

| | | | | |
|---|---|---|---|---|
| 7,540,355 | B2 * | 6/2009 | Harkonen | 187/290 |
| 7,540,356 | B2 * | 6/2009 | Smith et al. | 187/393 |
| 7,681,694 | B2 * | 3/2010 | Aulanko et al. | 187/290 |
| 7,967,113 | B2 * | 6/2011 | Smith et al. | 187/393 |
| 8,172,042 | B2 * | 5/2012 | Wesson et al. | 187/382 |
| 2005/0173198 | A1 | 8/2005 | Takehara et al. | |

* cited by examiner

CONTROL SYSTEM AND ENERGY STORAGE FOR AN ELEVATOR APPARATUS

CROSS REFERENCE TO RELATED APPLICATIONS

This application is a National Stage of International Application No. PCT/IB2009/052703 filed Jun. 24, 2009, which claims priority from Italian Patent Application No. TO2008A000494 filed Jun. 24, 2008, the contents of all of which are incorporated herein by reference in their entirety. The present invention relates to a control system for an elevator apparatus.

BACKGROUND OF THE INVENTION

The present invention relates to a control system for an elevator apparatus. More specifically, the invention relates to a control system with storage and reuse of energy for an elevator apparatus comprising a car or the like, which is movable between a lower level or floor and an upper level or floor, and driven by an alternate current reversible electrical machine, supplied with the energy provided by a source, and controlled through a first inverter; the system including energy storage means coupled to said first inverter and controlled through a second inverter, and adapted to store the energy generated by said electrical machine and the energy coming from the source and optionally not used by said machine, as well as to deliver at least part of the stored energy towards said machine, when the latter consumes energy above a threshold.

Such control systems are known, for example, from U.S. Pat. Nos. 5,936,375 and 7,165,654.

BRIEF SUMMARY OF THE INVENTION

An object of the present invention is to provide an improved control system of that kind.

This and other objects are achieved according to the invention with a system of the above-defined type, characterized in that it is arranged to automatically cause the lifting of the car up to the upper floor when preset conditions occur in a time interval of inactivity of the elevator apparatus.

By upper floor is meant the floor where the car potential energy is at its highest value. In the case of an elevator plant without counterweight, it coincides with the highest floor.

In a first embodiment, the system is arranged to automatically cause the lifting of the car up to the upper floor when the elevator apparatus results to have been inactive for a pre-established period of time.

According to a further characteristic, the system is arranged to automatically cause the lifting of the car up to the upper floor when the stored energy in the above-mentioned storage means falls below a predetermined threshold.

According to a further aspect, the present invention relates to a control system for an elevator apparatus comprising a car or the like and which can be moved by means of an a.c. reversible electrical machine, supplied with the energy which is provided by a source with a predetermined maximum supply power, and controlled through a first inverter; the system including

- energy storage means which are coupled to said first inverter and are controlled through a second inverter, and are adapted to store energy generated by said electrical machine and/or coming from the source, as well as to deliver at least part of the stored energy towards said machine; and

- control and regulation means arranged to drive said inverters according to pre-established modes.

A control system for elevators of such type is known, for example, from U.S. Pat. No. 5,712,456.

Therefore, a further object of the present invention is to provide an improved control system of such a type.

This further object is achieved according to the invention with a system of the above-defined type, characterized in that the control and regulation means are arranged to calculate the electric power which is operatively required or supplied by said electrical machine, and to drive the above-mentioned first and second inverters so as to:

- allow the supply of energy from the source to the electrical machine, when the electric power required by the machine is lower than or equal to the maximum supply power of the source;
- deliver the energy drawn from the storage means to the electrical machine, with a power corresponding to the difference between the electric power required by said machine and the maximum supply power of the source, when the latter is lower than the electric power required by the machine;
- store the energy supplied by said electrical machine and that coming from said source in the storage means, until when a state variable indicative of the charge condition of said storage means is lower than a preset maximum value; and
- store only the energy supplied by the electrical machine in the storage means, when said state variable exceeds said preset maximum value.

For those apparatuses in which the downward travel is not managed by a car-control electric motor such as, for example, the apparatuses with hydraulic actuation of the conventional type in which the descent speed is hydraulically controlled through a suitable valve, the control system uses the time of such ride to recharge the accumulator with energy at the value of the maximum power of the source. Furthermore, the recharge operation continues, after each ride, in the waiting times, until reaching a pre-established energy level.

BRIEF DESCRIPTION OF THE DRAWINGS

Further characteristics and advantages of the invention will result from the following detailed description, given by way of non-limiting example only, with reference to the annexed drawings, in which.

DETAILED DESCRIPTION OF THE INVENTION

The control system with storage and reuse of energy according to the invention is generally applicable to any elevator apparatus, with or without a counterweight.

Figure 1:
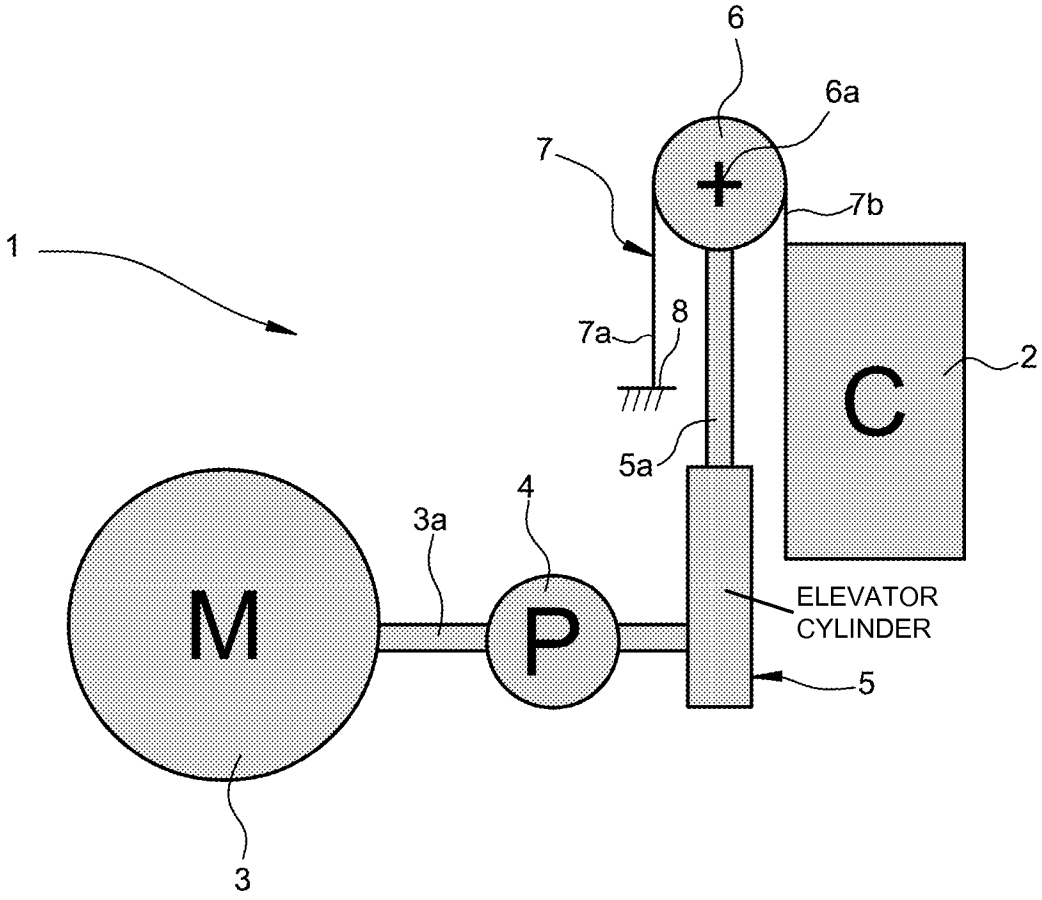
FIG. 1 is a schematic representation of an elevator apparatus to which a control system according to the present invention can be applied.

The system according to the invention is applicable, for example, to the elevator apparatus 1, the general scheme of which is represented in FIG. 1.

The elevator apparatus 1 of FIG. 1 comprises a car or the like 2, which is movable between a lower level or floor and an upper level or floor. By the terms "lower level or floor" and "upper level or floor" are generally meant two levels or floors not necessarily contiguous, but rather the extreme levels or floors between which the car 2 is operatively movable.

The elevator apparatus 1 is actuatable by means of an alternate current reversible electrical machine 3, for example, a three-phase induction motor, the shaft 3*a* of which drives in rotation a hydraulic pump 4, the delivery end of which supplies a flow of pressurized hydraulic fluid to an elevator cylinder 5, the stem 5*a* of which has a pulley 6 at the upper end. The pulley is rotatable about a horizontal axis 6*a* and a rope 7 is diverted around it, which rope has an end 7*a* fixed to a stationary point 8, and the other end 7*b* connected to the car 2.

Figure 2:
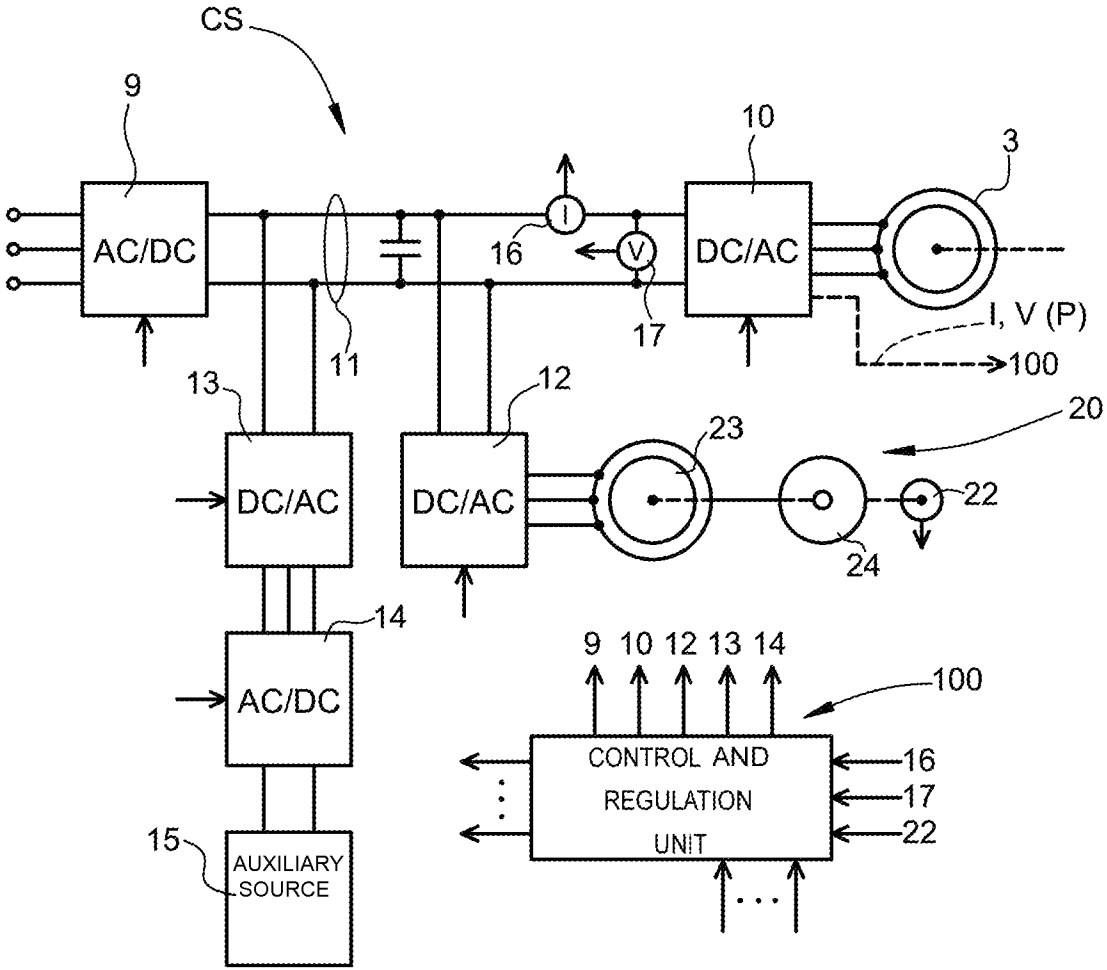
FIG. 2 is a partially block diagram of a first implementation mode of a control system according to the invention.

With reference to FIG. 2, in a first embodiment, a control system CS according to the invention for an elevator apparatus comprises a first inverter 10, the d.c. side of which is connected to the output of a rectifier device (a.c./d.c. converter) 9, and the a.c. side of which is connected to the supply terminals of the electrical machine 3.

The rectifier device 9, that can be monophase or multiphase, reversible or not reversible, has the a.c. side connected to an alternate current voltage source, in particular to the a.c. electric distribution network.

The d.c. side of the rectifier device 9 is connected to the input of the inverter 10 by means of a d.c. line or bus 11. A battery of voltage stabilizing capacitors is suitably connected in parallel to such d.c. line or bus.

The d.c. side of a second inverter 12 is connected to the bus 11, the a.c. side of which is connected to a unit for the storage of energy, which is generally indicated with 20 and which will be more clearly described herein below.

A further inverter 13 can be optionally connected to the bus 11, and the d.c. side thereof is connected to the output of a further rectifier device or controlled a.c./d.c. converter 14.

The latter has the d.c. side connected to a d.c. electric energy auxiliary source, indicated 15, such as one or more solar panels of the photovoltaic type, one or more fuel cells, etc.

The inverter 13 and the converter 14 can be integrated in a single d.c./d.c. converter.

In the exemplary embodiment schematically illustrated in FIG. 2, the energy storage unit 20 comprises a further a.c. reversible electrical machine 23, connected to the a.c. side of the inverter 12, and having the rotor coupled to a rotatable flywheel 24 having preferably a high inertia. An angular velocity electric sensor 22, of a per se known type, can be associated to the rotor of the machine 23, or to the flywheel 24.

If the control system CS is entirely produced as a new system, the inverter 10 which is part of it can be so arranged, in a per se known manner, as to provide signals indicative of the electric power transferred to the electrical machine 3 during the operation.

Moreover, the control system according to the invention can be implemented in combination with a pre-existing elevator apparatus, already provided with an inverter of its own, coupled to the electrical machine. In such case, the system can be suitably provided with two detectors of current and voltage, respectively, coupled to the d.c. side of said inverter, as it is illustrated by the detectors 16 and 17 of FIGS. 2 and 3.

Particularly, the current detector 16 is arranged so that it detects the current flowing in the portion of the bus 11 comprised between the d.c. side of the inverter 12 and the d.c. side of the inverter 10, downstream of the (optional) battery of capacitors. The voltage detector 17 detects the d.c. voltage between the two conductors of the bus 11.

The control system CS further comprises a control and regulation electronic unit, indicated 100 in FIG. 2. Such a unit has a plurality of inputs, to which the signals provided by the detectors 16, 17, and 22 arrive, if present, as well as a plurality of outputs, connected in an orderly way to the control inputs of the rectifier device 9, the inverters 10, 12, and 13, and the rectifier device 14.

The control system CS of FIG. 2 can be so arranged as to operate, for example, substantially according to what has been described in U.S. Pat. No. 5,936,375, which has been already mentioned above.

Figure 3:
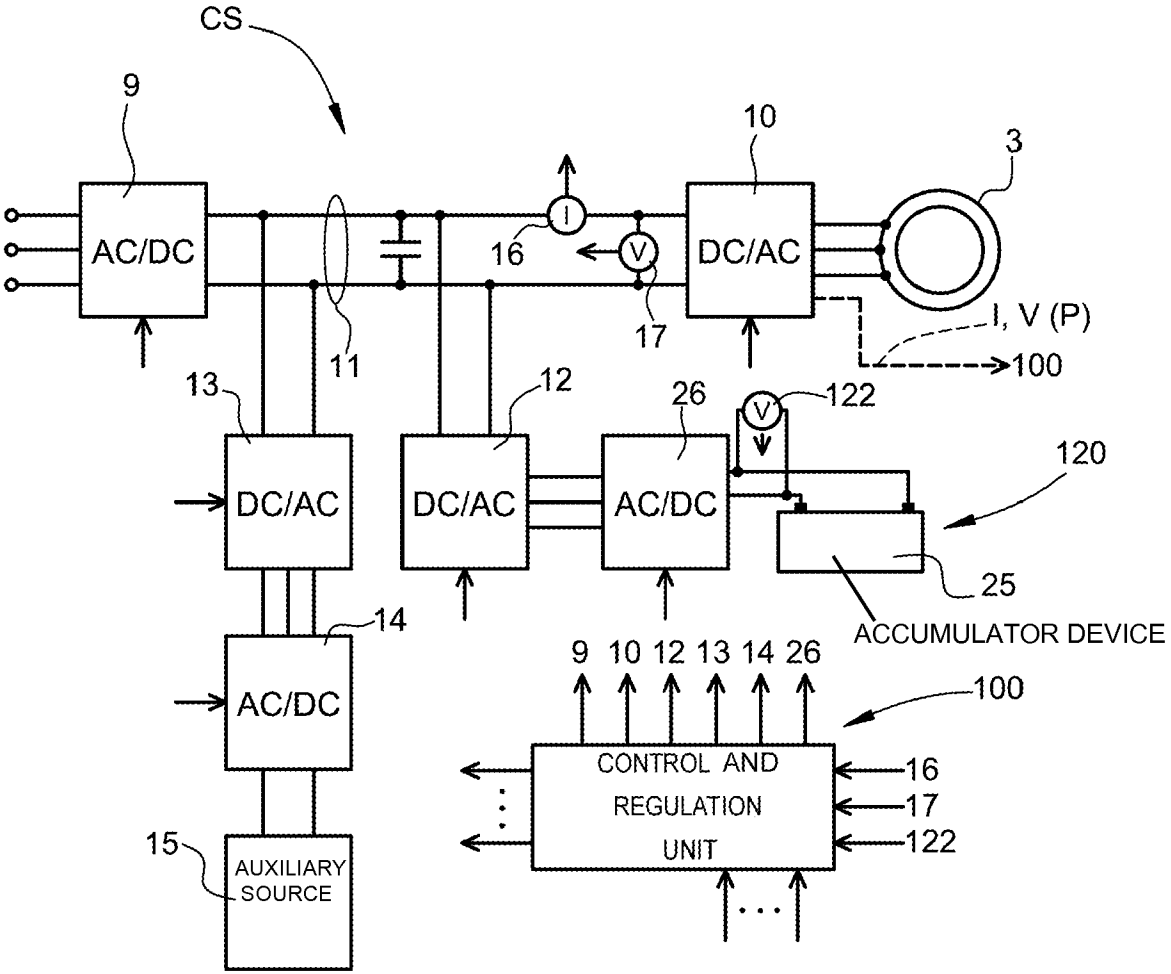
FIG. 3 is a partially block diagram of an implementation variation of a control system according to the invention.

In FIG. 3, a variant embodiment of the control system CS according to the invention is illustrated. In FIG. 3, the same reference numerals used before have been assigned again to already described parts and elements.

Compared to the system of FIG. 2, the control system according to FIG. 3 essentially differs in that in place of the energy storage system 20, now there is provided an energy storage 120, including an a.c./d.c. converter 26, interposed between the alternate current side of the inverter 12 and an electric accumulator device 25, such as a battery or a supercapacitor. A voltage detector 122 is associated to such an accumulator device 25, connected to a corresponding input of the control and regulation electronic unit 100. The latter has a further output, connected to a control input of the a.c./d.c. converter 26.

Also the inverter 12 and the converter 26 can be integrated in a single d.c./d.c. converter.

The control system CS according to FIG. 3 can be so arranged as to operate, for example, in accordance with what has been described in U.S. Pat. No. 7,165,654.

According to a first aspect of the present invention, the control system CS according to FIG. 2 or FIG. 3 can be suitably arranged to cause, through the electrical machine 3 operating as a motor, the lifting of the car 2 up to the highest floor of the hoistway, when predetermined conditions occur in a time interval of inactivity of the elevator apparatus.

In a first implementation mode, the control system CS is suitably arranged to automatically cause the lifting of the car 2 up to the highest floor of the hoistway, when the elevator apparatus results to have been inactive for a pre-established period of time.

In another implementation mode, the system can be (further) arranged to automatically cause the lifting of the car 2 up to the highest floor of the hoistway, when the stored energy in the storage unit 20 or 120 falls below a predetermined threshold.

After automatically bringing the car 2 to the highest floor of the hoistway, it shall be apparent that, at the successive use of the elevator system, the car 2 can only go down. In such descent, the potential energy previously "stored" in the elevator system is used to recharge the storage unit 20 or 120.

Upon the successive ascent of the car, the control system CS can operate so as to use the electric energy coming from the network, moreover suitably without exceeding a pre-established maximum limit (particularly, the limit of maximum supply power contractually agreed with the network service provider, for example, 3 kW), using additional energy, where required, drawn from the storage unit 20 or 120, through the inverter 12, and optionally the additional energy provided by the auxiliary source 15.

Upon the first use of the elevator apparatus after an automatic lifting to the highest floor of the hoistway, the control system CS is suitably arranged to drive the first inverter 10 so as to control the descent speed of the car 2 according to a predetermined function of the stored energy in the storage unit 20 or 120. The speed, therefore the descent time, of the car, can be in particular controlled so as to ensure a very efficient recharge for the storage unit 20 or 120.

The control system CS can be further suitably arranged to make so that the pause between the first descent and the first ascent after an automatic lifting of the car to the top floor of the hoistway has a preset minimum duration, adapted to allow the storage system 20 or 120 to reach a preset value of stored energy.

Moreover, according to a further aspect of the present invention, the control system CS can reduce the waiting time for the complete recharge by controlling the ascent of the car through the inverter 10 at a reduced speed, when a predetermined value of minimum energy required is reached in the accumulator. In this manner, the power required by the car is lower, and the accumulator is required to provide a reduced contribution.

According to another new and innovative aspect of the present invention, the control and regulation electronic unit 100 in the control system CS is suitably arranged to calculate the electric power P operatively required or supplied by the electrical machine 3 relative to the handling of the car 2. Such electric power P can be easily determined in different ways, as noted herein below.

A simple, but not very suitable mode is implemented on the basis of the indications provided by the current and voltage detectors 16 and 17. This mode is to be preferred when the inverter 10 is the actual inverter of a pre-existing elevator apparatus to which a control system according to the invention is associated.

Another mode, to be preferred, uses the current sensors typically already present on the inverter 10. In fact, for the control of the operative current, the inverter 10 is generally provided with two two-phase current sensors in series with the motor 3, the measured current values of which are herein indicated ia and ib. Since, for the solenoidality of the currents, ic=−ia−ib, all the currents of the motor are known. The voltages applied to the motor 3 by the inverter 10 are given by the modulation index of each phase, multiplied by the bus voltage of the control; therefore such voltages are known, and are herein referred to as va, vb and vc, respectively. Then, the instantaneous power is simply given by the known relationship P=va*ia+vb*ib+vc*ic.

Still to be preferred is a method which operates on the quantities according to the axis variables, that is converting the above-mentioned voltages and currents through the known Park transform, whereby the vd (direct) and vq (quadrature) voltages and the id (direct) and iq (quadrature) currents are determined. Then the power is simply given by the relationship P=K*(vd*id+vq*iq), where K=⅔. If, finally, the angle θ of the Park transform is suitably selected so that it is vq=0, then the power is given by the relationship P=K*vd*id. It is to be considered that the thus-calculated power is the one absorbed by the motor 3; the power absorbed by the inverter 10 will be slightly higher, however by a negligible amount.

The same operations are performed for the calculation of the power absorbed or delivered by the inverter 12.

The unit 100 is suitably arranged to drive the inverters 10 and 12 and, in the case of the architecture according to FIG. 3, also the a.c./d.c. converter 26, so as to:

when the electric power P required by the machine 3 is lower than or equal to the maximum supply power $P_{CM}$ (maximum contractual supply power) of the network, allow the supply to the machine 3 of energy coming from the network; furthermore, if the stored energy in the unit 20 or 120 is lower than a preset maximum value, in such unit 20 or 120 the energy coming from the network is stored with a power corresponding to the difference between the maximum supply power $P_{CM}$ of the network (and optionally from the auxiliary source 15) and the power P required by the machine 3 until reaching the preset maximum energy value in the accumulator;

when the maximum supply power $P_{CM}$ of the network is lower than the electric power P required by the machine 3, deliver to the electrical machine 3 also the energy drawn from the storage unit 20 or 120, with a power corresponding to the difference between the power P required by the machine 3 and the maximum supply power $P_{CM}$ of the network with the car speed being at its nominal value if the stored energy in the accumulator is above a predetermined minimum value, otherwise, controlling the inverter 10, and therefore the motor 3, to reduce the car speed according to a predetermined law;

when the stored energy in the unit 20 or 120 is lower than a preset maximum value, store in such unit 20 or 120 the energy which is supplied by the electrical machine 3 (if available) as well as the energy coming from the network (and optionally from the auxiliary source 15) and not used by the machine 3, until reaching the preset maximum energy value; and when the stored energy in the unit 20 and 120 exceeds the above-mentioned preset maximum value, store only the energy supplied by the electrical machine 3 operating as a generator (if available), in the unit 20 and 120.

Therefore, during the ascent of the car, the storage unit 20 or 120 provides the surplus of power required for the proper functioning of the elevator apparatus, while, during the descent, the storage unit 20 or 120 recharges for the successive ascent.

The charging can continue also until reaching the arrival level, both immediately after an ascent and immediately after a descent, until reaching the preset maximum energy value. After such a recharge, the storage system is inert until the elevator is called for a new ride, unless a minimum energy storage value is reached, in which case the car is brought to the upper floor by transferring the maximum energy content from the accumulator to the car and waiting for the call for a new ride.

In these conditions, the energy stored in the accumulator could also be annulled due to the long inactivity time, due to the inevitable losses of the accumulator. Since the successive run can only be a descent, therefore to the detriment of the potential energy stored in the car, the accumulator has the possibility to recharge, therefore to get ready to the proper operativeness, avoiding unnecessary energy losses for the maintenance of the charge in the accumulator.

The charge condition of the storage unit 20 and 120 can be suitably assessed on the basis of a state variable which, in the case of the storage unit 20 of FIG. 2, is related to the rotation speed of the flywheel 24, while in the case of the storage unit 120 of FIG. 3 is related to the voltage $V_A$ on the electric accumulator 25.

It shall be apparent that, the principle of the invention remaining unchanged, the embodiments and the implementation details can be widely varied with respect to what has been described and illustrated merely by way of a non-limiting example, without however departing from the scope of the invention as defined in the annexed claims.

The invention claimed is:

1. A control system for an elevator apparatus comprising a single car without counterweight, which is movable between a lower level or floor and an upper level or floor, and driven by an a.c. reversible electrical machine with the energy provided by a source, and controlled through a first inverter;

the system comprising energy storage means coupled to said first inverter and controlled through a second inverter, and adapted to store energy generated by said electrical machine and energy coming from the source and optionally not used by said machine, as well as to deliver the stored energy towards said machine when the latter requires a power higher than a threshold;

the system being arranged to automatically cause, during normal operation of the elevator apparatus, a lifting of the car up to the upper floor when preset conditions occur in a time interval of inactivity of the elevator apparatus.

2. The system according to claim 1, wherein the system is arranged to automatically cause the lifting of the car up to the upper floor when the elevator apparatus results to have been inactive for a pre-established period of time.

3. The system according to claim 1, wherein the system is arranged to automatically cause the lifting of the car up to the upper floor when the stored energy in said storage means falls below a predetermined threshold.

4. The system according to claim 1, which, upon the first use of the elevator apparatus after an automatic lifting of the car to the upper floor, drives said first inverter so as to control the descent speed of the car according to a predetermined function of the energy stored in said storage means.

5. The system according to claim 1, wherein the storage means comprise a further a.c. reversible electrical machine connected to the output of the second inverter and coupled to a rotatable flywheel; said state variable being related to the rotation speed of said flywheel.

6. The system according to claim 1, wherein the storage means comprise an electric accumulator coupled to the output of the second inverter through current rectifier means; said state variable being related to the voltage on said electric accumulator.

7. The system according to claim 1, wherein, after the use of the elevator apparatus, the control unit continues to absorb power from the network within the predetermined maximum limit for a predetermined time.

8. The system according to claim 1, wherein, after the use of the elevator apparatus, the control unit continues to absorb power from the network within the predetermined maximum limit until the energy in the storage means reaches a preset maximum value.

9. The system according to claim 1, in which a converter is connected to the bus, to which a d.c. electric energy auxiliary source is connected, the d.c, electric energy source comprises at least one of a solar panel or a fuel cell.

10. The system according to claim 1, coupled to the source through a converter of the bidirectional or reversible type.

11. The system according to claim 1, wherein the control is arranged to control said first inverter so that the car speed is a predetermined function of the state variable indicative of the charge condition of said storage means.

* * * * *